US010115326B2

(12) United States Patent
Byun

(10) Patent No.: US 10,115,326 B2
(45) **Date of Patent: *Oct. 30, 2018**

(54) DISPLAY DEVICE

(71) Applicant: SAMSUNG DISPLAY CO., LTD., Yongin-si, Gyeonggi-Do (KR)

(72) Inventor: Min Woo Byun, Seongnam-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 156 days.

This patent is subject to a terminal disclaimer.

(21) Appl. No.: 15/087,041

(22) Filed: Mar. 31, 2016

(65) Prior Publication Data

US 2016/0293078 A1 Oct. 6, 2016

(30) Foreign Application Priority Data

Mar. 31, 2015 (KR) ..... 10-2015-0045218

(51) Int. Cl.
*G09G 5/00* (2006.01)
*G09G 3/00* (2006.01)

(52) U.S. Cl.
CPC ..... *G09G 3/006* (2013.01); *G09G 2300/0426* (2013.01); *G09G 2310/06* (2013.01); *G09G 2330/12* (2013.01)

(58) Field of Classification Search
USPC ..... 345/214
See application file for complete search history.

(56) References Cited

U.S. PATENT DOCUMENTS

| | | | | |
|---|---|---|---|---|
| 9,767,727 | B2 * | 9/2017 | Byun | G09G 3/3208 |
| 2008/0191213 | A1 * | 8/2008 | Bae | H01L 29/458 257/66 |
| 2010/0134137 | A1 * | 6/2010 | Kida | G02F 1/1309 324/757.01 |
| 2012/0139829 | A1 * | 6/2012 | Anno | G06F 3/041 345/156 |
| 2014/0176844 | A1 * | 6/2014 | Yanagisawa | G02F 1/1309 349/43 |
| 2014/0217373 | A1 * | 8/2014 | Youn | H01L 23/4985 257/40 |

FOREIGN PATENT DOCUMENTS

| | | |
|---|---|---|
| JP | 2014-021479 | 2/2014 |
| JP | 2014-122974 | 7/2014 |
| KR | 1020140064553 | 5/2014 |
| KR | 1020140091916 | 7/2014 |

* cited by examiner

*Primary Examiner* — Srilakshmi K Kumar
*Assistant Examiner* — Chineyere Wills-Burns
(74) *Attorney, Agent, or Firm* — F. Chau & Associates, LLC

(57) ABSTRACT

A display device according to an exemplary embodiment of the present disclosure includes: a substrate that includes a display area and a peripheral area around the display area; a plurality of data lines on the substrate; and a crack sensing line disposed in the peripheral area and that is connected to a first data line of the plurality of data lines, where the crack sensing line includes a first layer disposed under an insulating layer and a second layer disposed on the insulating layer, the first layer and the second layer each include overlapping parts where the first layer and the second layer overlap via the insulating layer, and a voltage applied to the first layer and a voltage applied to the second layer have different magnitudes.

7 Claims, 9 Drawing Sheets

DISPLAY DEVICE

CROSS-REFERENCE TO RELATED APPLICATION

This application claims priority under 35 U.S.C. § 119 from, and the benefit of Korean Patent Application No. 10-2015-0045218 filed in the Korean Intellectual Property Office on Mar. 31, 2015, the contents of which are herein incorporated by reference in their entirety.

BACKGROUND (a) Technical Field

Embodiments of the present disclosure are directed to a display device.

(b) Discussion of the Related Art

With the development of portable display devices, the display has evolved into a flat flexible form.

In the manufacturing process of a display device, when a crack is generated, moisture may penetrate into the display area of the display device. The penetration of moisture due to these cracks may cause failure of the display device.

Therefore, accurate detection of the formation of cracks is useful.

SUMMARY

Embodiments of the present disclosure can provide a display device in which a failure due to a crack can be prevented by detecting a crack.

A display device according to an exemplary embodiment of the present disclosure includes: a substrate that includes a display area and a peripheral area around the display area; a plurality of data lines on the substrate; and a crack sensing line disposed in the peripheral area and that is connected to a first data line of the plurality of data lines, wherein the crack sensing line includes a first layer disposed under an insulating layer and a second layer disposed on the insulating layer, the first layer and the second layer each include overlapping parts where the first layer and the second layer overlap via the insulating layer, and a voltage applied to the first layer and a voltage applied to the second layer have different magnitudes.

The second layer may be connected to the first data line, and the first layer may not be connected to the first data line.

The first layer and the second layer may each have a serpentine shape, wherein the serpentine shape of the first layer may be about 180° out of phase with the serpentine shape of the second layer, and the overlapping part may be where the first layer and the second layer overlap each other.

One of the first layer and the second layer may have a serpentine shape, and the other of the first layer and the second layer may have a linear shape that extends in one direction.

The first layer may have a zigzag shape of connected first line segments and second line segments that alternate with each other and are obliquely disposed with respect to each other, the second layer may have a zigzag shape of connected third line segments and fourth line segments that alternate with each other and are obliquely disposed with respect to each other, and in the overlapping parts, the first line segment of the first layer and the fourth line segment of the second layer may overlap each other, and the second line segment of the first layer and the third line segment of the second layer may overlap each other.

One of the first layer and the second layer may have a zigzag shape, and the other of the first layer and the second layer may have a linear shape that extends in one direction.

The first layer may have a square-wave shape that includes a first longitudinal part and a second longitudinal part that are separated from and alternate with each other, and are connected by a first transverse part, the second layer may have a square-wave shape that includes a third longitudinal part and a fourth longitudinal part that are separated from and alternate with each other, and are connected by a second transverse part, and in the overlapping parts, the first transverse part of the first layer may alternately overlap the third longitudinal part and the fourth longitudinal part of the second layer, and the second transverse part of the second layer may alternately overlap the first longitudinal part and the second longitudinal part of the first layer.

One of the first layer and the second layer may have a square-wave shape, and the other of the first layer and the second layer may have a linear shape that extends in one direction.

The display device may further include a plurality of pixels formed in the display area of the substrate and that are connected to the plurality of data lines and the crack sensing line; and a first test signal line and a second test signal line formed in the peripheral area of the substrate and that are connected to the plurality of pixels. The first crack sensing line may be connected to the first data line through a first connection part and a second connection part, the first crack sensing line may extend in a hemiring shape from the first connection part to the second connection part, and the plurality of data lines may be connected to the first test signal line through a first switching element and may be connected to the second test signal line through a second switching element.

A display device according to another exemplary embodiment of the present disclosure includes a substrate that includes a display area and a peripheral area around the display area; a plurality of data lines on the substrate; and a crack sensing line disposed in the peripheral area and that is connected to a first data line of the plurality of data lines, wherein the crack sensing line includes a first layer disposed under an insulating layer and a second layer disposed on the insulating layer, the first layer and the second layer each include overlapping parts where the first layer and the second layer overlap via the insulating layer, the second layer is connected to the first data line, and the first layer is not connected to the first data line.

A voltage applied to the first layer and a voltage applied to the second layer may have different magnitudes.

The first layer and the second layer may each have a serpentine shape, wherein the serpentine shape of the first layer may be about 180° out of phase with the serpentine shape of the second layer, and the overlapping part may be where the first layer and the second layer overlap each other.

One of the first layer and the second layer may have a serpentine shape, and the other of the first layer and the second layer may have a linear shape that extends in one direction.

The first layer may have a zigzag shape of connected first line segments and second line segments that alternate with each other and are obliquely disposed with respect to each other, the second layer may have a zigzag shape of connected third line segments and fourth line segments that alternate with each other and are obliquely disposed with respect to each other, and in the overlapping parts, the first line segment of the first layer and the fourth line segment of the second layer may overlap each other, and the second line segment of the first layer and the third line segment of the second layer may overlap each other.

One of the first layer and the second layer may have a zigzag shape, and the other of the first layer and the second layer may have a linear shape that extends in one direction.

The first layer may have a square-wave shape that includes a first longitudinal part and a second longitudinal part that are separated from and alternate with each other and are connected by a first transverse part, the second layer may have a square-wave shape that includes a third longitudinal part and a fourth longitudinal part that are separated from and alternate with each other, and are connected by a second transverse part, and in the overlapping parts, the first transverse part of the first layer may alternately overlap the third longitudinal part and the fourth longitudinal part of the second layer, and the second transverse part of the second layer may alternately overlap the first longitudinal part and the second longitudinal part of the first layer.

One of the first layer and the second layer may have square-wave shape, and the other of the first layer and the second layer may have a linear shape that extends in one direction.

The display device may further include a plurality of pixels formed in the display area of the substrate and that are connected to the plurality of data lines and the crack sensing line; and a first test signal line and a second test signal line formed in the peripheral area of the substrate and that are connected to the plurality of pixels. The first crack sensing line may be connected to the first data line through a first connection part and a second connection part, the first crack sensing line may extend in a hemiring shape from the first connection part to the second connection part, and the plurality of data lines may be connected to the first test signal line through a first switching element and are connected to the second test signal line through a second switching element.

A display device according to another exemplary embodiment of the present disclosure includes a substrate that includes a display area and a peripheral area around the display area; a plurality of data lines on the substrate; and a crack sensing line disposed in the peripheral area and that is connected to a first data line of the plurality of data lines, wherein the crack sensing line includes a first layer disposed under an insulating layer and a second layer disposed on the insulating layer, the second layer is connected to the first data line, the first layer is not connected to the first data line, and a voltage applied to the first layer and a voltage applied to the second layer have different magnitudes.

The first layer and the second layer may each include overlapping parts where the first layer and the second layer overlap via the insulating layer.

According to a display device according to an exemplary embodiment of the present disclosure, a crack of a display device may be detected, thereby preventing a failure of the display device due to the crack.

DETAILED DESCRIPTION OF EXEMPLARY EMBODIMENTS

Figure 1:
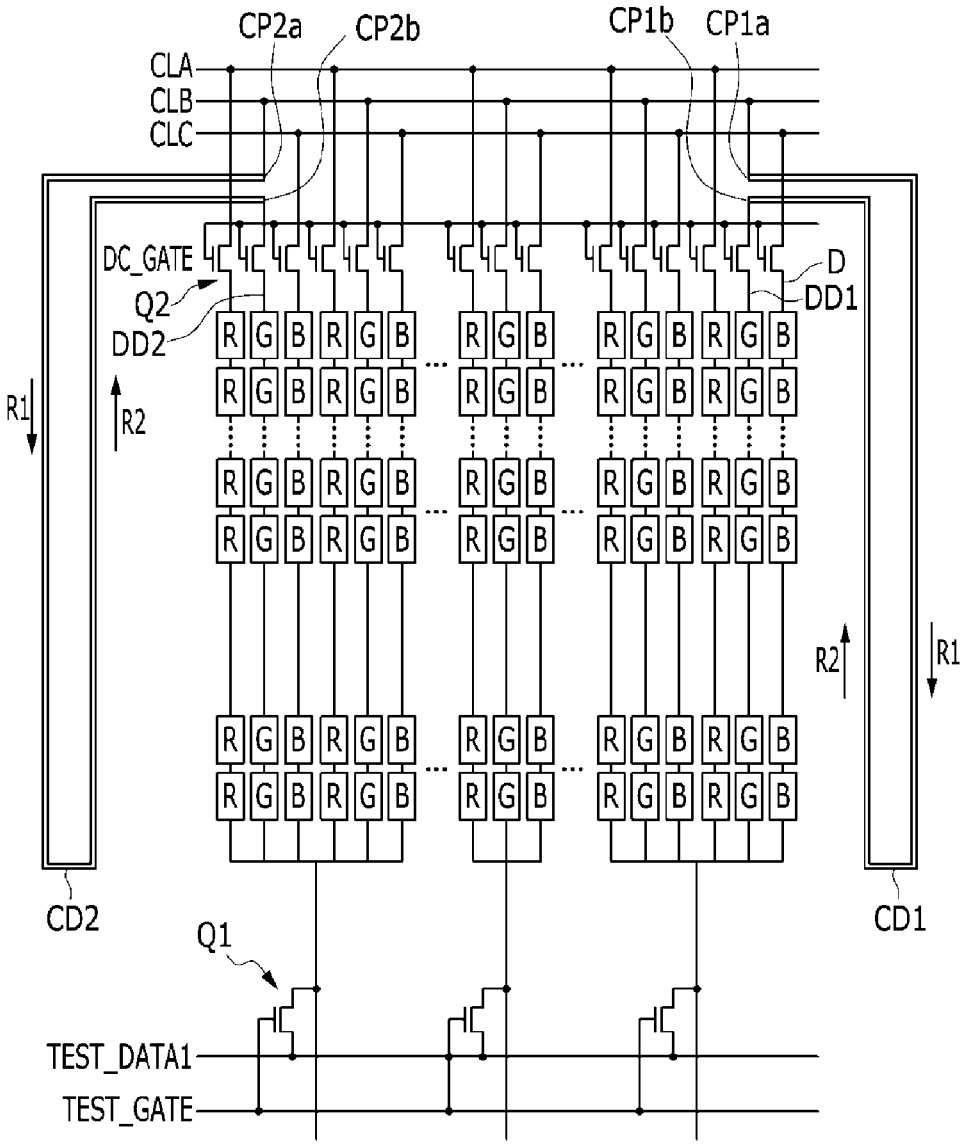
FIG. 1 is a layout view of a display device according to an exemplary embodiment of the present disclosure.

Embodiments of the present disclosure will be described more fully hereinafter with reference to the accompanying drawings, in which exemplary embodiments of the disclosure are shown. As those skilled in the art would realize, the described embodiments may be modified in various different ways, all without departing from the spirit or scope of the present disclosure.

In the drawings, the thickness of layers, films, panels, regions, etc., may be exaggerated for clarity. Like reference numerals may designate like elements throughout the specification. It will be understood that when an element such as a layer, film, region, or substrate is referred to as being "on" another element, it can be directly on the other element or intervening elements may also be present.

Figure 2:
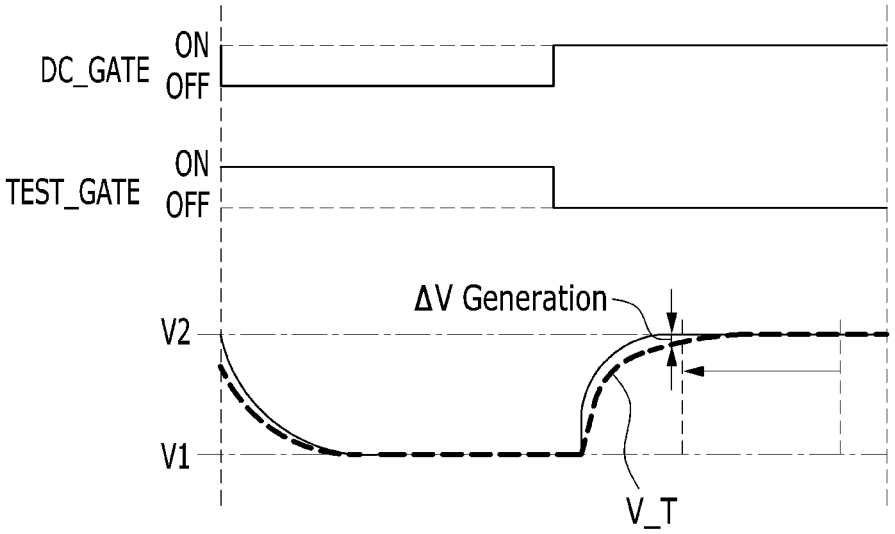
FIG. 2 is a waveform diagram of signals of a display device according to an exemplary embodiment of the present disclosure.
Figure 3:
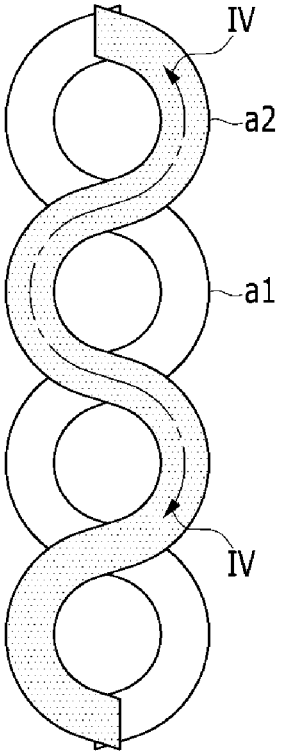
FIG. 3 illustrates a portion of the display device according to the exemplary embodiment shown in FIG. 1.

Now, a display device according to an exemplary embodiment of the present disclosure will be described with reference to FIG. 1 to FIG. 3. FIG. 1 is a layout view of a display device according to an exemplary embodiment of the present disclosure, FIG. 2 is a waveform diagram of signals of a display device according to an exemplary embodiment of the present disclosure, and FIG. 3 illustrates a portion of the display device according to the exemplary embodiment shown in FIG. 1.

First, a display device according to an exemplary embodiment of the present disclosure will be described with reference to FIG. 1.

Referring to FIG. 1, a display device according to an exemplary embodiment of the present disclosure includes a substrate divided into a display area and a peripheral area circumjacent to the display area.

A display device according to an exemplary embodiment of the present disclosure includes a plurality of pixels R, G, and B disposed on the substrate and a plurality of signal lines connected thereto, wherein the plurality of pixels R, G, and B are disposed in the display area of the substrate, and at least a portion of the plurality of signal lines are disposed in the peripheral area of the substrate.

The plurality of signal lines include a first test gate line TEST_GATE, a second test gate line DC_GATE, a plurality of data lines D, a first test signal line TEST_DATA1, a plurality of second test signal lines CLA, CLB, and CLC, a first crack sensing line CD1, and a second crack sensing line CD2.

A plurality of first switching elements Q1 are connected to the first test gate line TEST_GATE, the first test signal line TEST_DATA1, and the plurality of data lines D, and a plurality of second switching elements Q2 are connected to the second test gate line DC_GATE, the plurality of second test signal lines CLA, CLB, and CLC, and the plurality of data lines D.

Among the plurality of data lines D, the first crack sensing line CD1 is connected to a first data line DD1, and the second crack sensing line CD2 is connected to a second data line DD2.

The first crack sensing line CD1 and the second crack sensing line CD2 are respectively disposed on each side of the plurality of pixels R, G, and B, and are disposed in the peripheral area adjacent to both edges of the display area in which the plurality of pixels R, G, and B are disposed.

The first crack sensing line CD1 is connected to the first data line DD1 through a first connection portion CP1*a* and a second connection portion CP1*b*. The first crack sensing line CD1 starts from the first connection portion CP1*a*, extends in a first direction R1 along the peripheral area adjacent to the edge of the display area, extends in a second direction R2 that is opposite to the first direction R1, and again connects to the first data line DD1 through the second connection portion CP1*b*. Similarly, the second crack sensing line CD2 is connected to the second data line DD2 through the third connection portion CP2*a* and the fourth connection portion CP2*b*. The second crack sensing line CD2 starts from the third connection portion CP2*a*, extends in the first direction R1 along the peripheral area adjacent to the edge of the display area, extends in the second direction R2 that is opposite to the first direction R1, and again connects to the first data line DD1 through the fourth connection portion CP2*b*.

As described above, the first crack sensing line CD1 and the second crack sensing line CD2 are respectively formed in the peripheral area respectively adjacent to each edge of the display area, extend in the first direction R1 along the peripheral area from the connection portion of the first data line DD1 and the second data line DD2, extend in the second direction R2 opposite to the first direction R1, and again connected to the first data line DD1 and the second data line DD2, thereby forming a hemiring shape.

Figure 4:
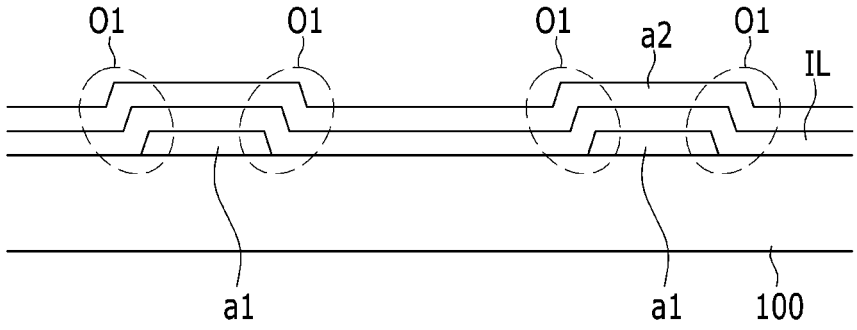
FIG. 4 is a cross-sectional view of a portion taken along a line IV-IV of FIG. 3.

As shown in FIGS. 3 and 4, the first crack sensing line CD1 and the second crack sensing line CD2 include a first layer a1 formed under an insulating layer IL and a second layer a2 formed on the insulating layer IL. The first layer a1 and the second layer a2 each include an overlapping part where they overlap each other via the insulating layer IL, and a non-overlapping part where the first layer a1 and the second layer a2 do not overlap each other.

The first layer a1 of the first and second crack sensing lines CD1 and CD2 may receive a voltage of a predetermined magnitude from a voltage source. The second layer a2 of the first and second crack sensing lines CD1 and CD2 are connected to the first data line DD1 and the second data line DD2, and receive a voltage of the same magnitude as the voltage applied to the first data line DD1 and the second data line DD2.

The magnitude of the voltage received by the first layer a1 of the first and second crack sensing lines CD1 and CD2 differs from the magnitude of the voltage received by the second layer a2 from the first data line DD1 and the second data line DD2. In detail, the magnitude of the voltage applied to the first layer a1 of the first and second crack sensing lines CD1 and CD2 may be less than the magnitude of the voltage applied received by the second layer a2 from the first data line DD1 and the second data line DD2.

Next, an operation of a display device according to an exemplary embodiment of the present disclosure will be described with reference to FIG. 2.

Referring to FIG. 2, if the first test gate line TEST_GATE receives a gate-on signal ON, the plurality of second switching elements Q2 connected to the plurality of data lines D turn on such that a first signal V1 applied to the first test signal line TEST_DATA1 is applied to the plurality of data lines D. The first signal V1 is for displaying white through the plurality of pixels R, G, and B.

By applying the first signal V1 to the plurality of data lines D, the plurality of pixels R, G, and B can display white.

After the first test gate line TEST_GATE receives a gate-off signal OFF, if the second test gate line DC_GATE receives a gate-on signal ON, the plurality of second switching elements Q2 connected to the plurality of data lines D turns on, and a second signal V2 received from the plurality of second test signal lines CLA, CLB, and CLC is applied to the plurality of data lines D. The second signal V2 is or displaying black through the plurality of pixels R, G, and B.

By applying the second signal V2 to the plurality of data lines D, the plurality of pixels R, G, and B can display black.

In this case, if a crack is generated in the peripheral area adjacent to the edge of the display area, the first and second crack sensing lines CD1 and CD2 in the peripheral area can be damaged. Accordingly, resistance of the first and second data lines DD1 and DD2 respectively connected to the first and second crack sensing lines CD1 and CD2 increases such that a voltage V_T applied to the pixels connected to the first and second data lines DD1 and DD2 does not charge until receipt of the second signal V2, and as a result, a voltage difference ΔV with the second. signal V2 is generated.

By causing the voltage difference between ΔV, pixels connected to the first and second data lines DD1 and DD2 do not display black and are displayed brightly. Through a bright line, a crack that may be generated in the peripheral area may be sensed.

However, even if a crack is generated in the peripheral area adjacent to the edge of the display area, if the first and second crack sensing lines CD1 and CD2 are undamaged, the crack may not be detected.

Next, a crack sensing line will be described with reference to FIG. 3 and FIG. 4.

Referring to FIG. 3 and FIG. 4, the first and second crack sensing lines CD1 and CD2 of display device according to an exemplary embodiment of the present disclosure are disposed on the substrate 100, and include the first layer a1 formed under the insulating layer IL and the second layer a2 formed on the insulating layer IL, and the first and second layers a1 and a2 include overlapping parts O1 where they overlap each other via the insulating layer IL and non-overlapping parts where the first and second layers a1 and a2 do not overlap each other.

In this way, the first and second crack sensing lines CD1 and CD2 overlap each other in the overlapping part O1, thereby generating a step in the overlapping part O1. The thickness of the insulating layer IL is less at the side of the step, so that when an external force is received, the insulating layer IL may be easily damaged in the step portion. If the insulating layer IL is damaged in the overlapping part O1, the first and second layers a1 and a2 overlapping each other via the insulating layer IL may be shorted.

If a crack is generated in the insulating layer IL, but the second layer a1, which receives the second signal V2, is not disconnected, the crack would not be detected in a conventional display device. However, according to a display device according to an exemplary embodiment of the present disclosure, although the first and second crack sensing lines CD1 and CD2 are not disconnected, the insulating layer IL is damaged in the overlapping part O1 and the overlapping first and second layers a1 and a2 are shorted so that the voltage received by the first layer a1 affects the magnitude of the voltage received by the second layer a2. As described above, the magnitude of the voltage received by the first layer a1 of the first and second crack sensing lines CD1 and CD2 may be less than the magnitude of the voltage received by the first and second data lines DD1 and DD2. Further, although the first and crack sensing lines CD1 and CD2 are not disconnected, the magnitude of the voltage applied to the second layer a2 of the first and second crack sensing lines CD1 and CD2 becomes less than the second voltage V2.

Accordingly, a signal transmitted to pixels connected to the first and second data lines DD1 and DD2 generates the voltage difference ΔV with respect to the second signal V2 received by the first and second data lines DD1 and DD2.

By causing the voltage difference ΔV, pixels connected to the first and second data lines DD1 and DD2 do not display black and are displayed brightly, and through the bright line, a crack generated in the peripheral area adjacent to the edge of the display area may be detected.

As described above, according to a display device according to an exemplary embodiment of the present disclosure, a crack sensing line includes a first layer a1 that received a relatively low voltage and a second layer a2 that receives a relatively high voltage, and the first and second layers a1 and a2 include an overlapping part O1 where they overlap each other via an insulating layer IL. Thus, the insulating layer IL can be disconnected at the step in the overlapping part R1, so that when a crack is generated, even though the crack sensing line is not disconnected, the crack may be detected. Accordingly, failure of a display device due to the crack may be prevented.

Again referring to FIG. 3, a crack sensing line according to an exemplary embodiment of the present disclosure has a serpentine shape with alternating "C" and reversed "C" portions, so that the "C" portion of the first layer a1 of the crack sensing line and the reversed "C" portion of the second layer a2 correspond to each other, and the reversed "C" portion of the first layer a1 and the "C" portion of the second layer a2 correspond to each other. In other words, the serpentine shape of the first layer a1 of the crack sensing line is about 180° out of phase with the serpentine shape of the second layer a2 of the crack sensing line. Accordingly, the overlapping part O1 is where the first layer a1 and the second layer a2 overlap each other, which is where the "C" portion and the reversed "C" portion meet.

Figure 5:
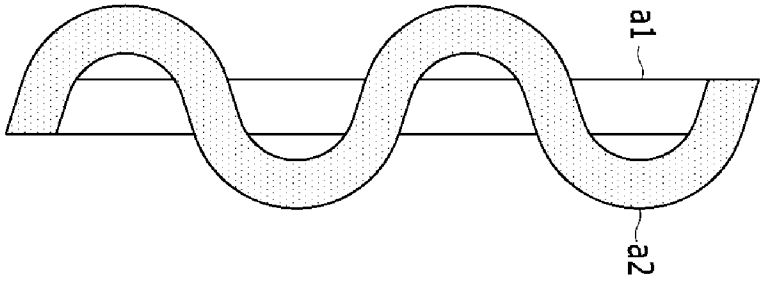
FIG. 5 illustrates a portion of a display device according to another exemplary embodiment of the present disclosure.

Next, a display device according to another exemplary embodiment of the present disclosure will be described with reference to FIG. 5 as well as FIG. 1 to FIG. 4. FIG. 5 illustrates a portion of a display device according to another exemplary embodiment of the present disclosure.

Referring to FIG. 5, a display device according to a present exemplary embodiment is similar to a display device according to an exemplary embodiment described with reference to FIG. 1 to FIG. 4, and thus a repeated detailed description of the same constituent elements is omitted.

As shown in FIG. 5, a crack sensing line of a display device according to a present exemplary embodiment includes a linear shaped first layer a1 and a serpentine shaped second layer a2 with alternating "C" portions and reversed "C" portions. Accordingly, the overlapping part O1 of the first and second layers a1 and a2 is the portion where the linear first layer a1 and the serpentine second layer a2 overlap. However, according to a display device according to another exemplary embodiment of the present disclosure, the first layer a1 of the crack sensing line may have a serpentine shape with alternating "C" and reversed "C" portions, and the second layer a2 of the crack sensing line may have a linear shape.

In this way, a crack sensing line of a display device according to a present exemplary embodiment overlaps in the overlapping part O1, thereby forming a step in the overlapping part O1. The thickness of the insulating layer IL is less at the side of the step, so that if an external force is received, the insulating layer IL may be damaged at the step. If the insulating layer IL is damaged, the overlapping first and second layers a1 and a2 can be shorted in the overlapping part O1.

As described above, the magnitude of a voltage received by the first layer a1 of the crack sensing line may be less than the magnitude of the voltage received by the second layer a2 from the first and second data lines DD1 and DD2, and although the first and second crack sensing lines CD1 and CD2 are not disconnected, the magnitude of the voltage received by the second layer a2 of the crack sensing line is less than that of the second voltage V2.

Accordingly, a signal transmitted to pixels connected to the first and second data lines DD1 and DD2 generates the voltage difference ΔV with the second signal V2 applied to the first and second data lines DD1 and DD2.

By causing the voltage difference ΔV, pixels connected to the first and second data lines DD1 and DD2 do not display black and are displayed brightly, and through the bright line, a crack generated in the peripheral area adjacent to the edge of the display area may be detected.

As described above, according to a display device according to an exemplary embodiment of the present disclosure, a crack sensing line includes a first layer a1 applied that receives a relatively low voltage and a second layer a2 that receives a relatively high voltage, and the first and second layers a1 and a2 include an overlapping part O1 where they overlap each other via the insulating layer IL. Thus, the insulating layer IL can be disconnected at the step in the overlapping part R1, so that when a crack is generated, even though the crack sensing line is not disconnected, the crack may be detected. Accordingly, failure of the display device due to the crack may be prevented.

All characteristics of a display device according to an exemplary embodiment of FIG. 1 to FIG. 4 may be applied to a display device according to a present exemplary embodiment.

Figure 6:
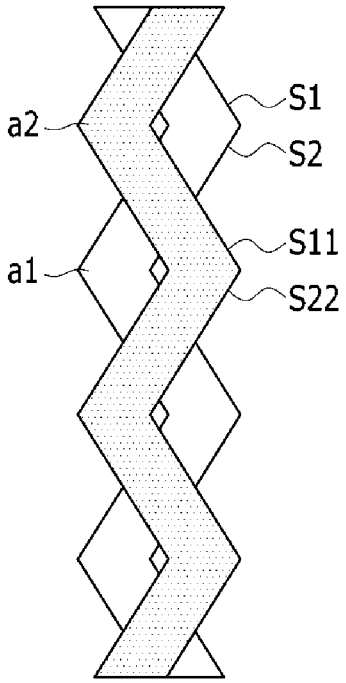
FIG. 6 illustrates a portion of a display device according to another exemplary embodiment of the present disclosure.

Next, a display device according to another exemplary embodiment of the present disclosure will be described with reference to FIG. 6 as well as FIG. 1 to FIG. 4. FIG. 6 illustrates a portion of a display device according to another exemplary embodiment of the present disclosure.

Referring to FIG. 6, a display device according to a present exemplary embodiment is similar to the display device according to an exemplary embodiment described with reference to FIG. 1 to FIG. 4, and thus a repeated detailed description of the same constituent elements is omitted.

As shown in FIG. 6, the first layer a1 of a crack sensing line of a display device according to a present exemplary embodiment has a zigzag shape of alternating obliquely disposed first and second line segments S1 and S2 connected to each other, and the second layer a2 of the crack sensing line has a zigzag shape of alternating obliquely disposed third and fourth line segments SS1 and SS2 connected to each other.

The first line segment S1 of the first layer a1 corresponds to the fourth line segment SS2 of the second layer a2, and the second line segment S2 of the first layer a1 corresponds to the third line segment SS1 of the second layer a2. Accordingly, in the overlapping parts O1, the first line segment S1 of the first layer a1 and the fourth line segment SS2 of the second layer a2 overlap each other, and the second line segment S2 of the first layer a1 and the third line segment SS1 of the second layer a2 overlap each other.

In this way, a crack sensing line of a display device according to a present exemplary embodiment overlaps in the overlapping part O1, thereby forming a step in the overlapping part O1. The thickness of the insulating layer IL is less at the side of the step, so that if an external force is received, the insulating layer IL may be damaged at the step. If the insulating layer IL is damaged, the overlapping first and second layers a1 and a2 can be shorted in the overlapping part O1.

As described above, a magnitude of a voltage received by the first layer a1 of the crack sensing line may be less than the magnitude of the voltage received by the second layer a2 from the first and second data lines DD1 and DD2, and although the first and second crack sensing lines CD1 and CD2 are not disconnected, the magnitude of the voltage received by the second layer a2 of the crack sensing line is less than that of the second voltage V2.

Accordingly, a signal transmitted to pixels connected to the first and second data lines DD1 and DD2 generates the voltage difference ΔV with the second signal V2 applied to the first and second data lines DD1 and DD2.

By causing the voltage difference ΔV, pixels connected to the first and second data lines DD1 and DD2 do not display black and are displayed brightly, and through the bright line, a crack generated in the peripheral area adjacent to the edge of the display area may be detected.

As described above, according to a display device according to an exemplary embodiment of the present disclosure, a crack sensing line includes a first layer a1 that receives a relatively low voltage and a second layer a2 that received a relatively high voltage, and the first and second layers a1 and a2 include an overlapping part O1 where they overlap each other via the insulating layer IL. Thus, the insulating layer IL can be disconnected at the step in the overlapping part O1, so that when a crack is generated, even though the crack sensing line is not disconnected, the crack may be detected. Accordingly, failure of the display device due to the crack may be prevented.

All characteristics of a display device according to an exemplary embodiment of FIG. 1 to FIG. 4 may be applied to a display device according to a present exemplary embodiment.

Figure 7:
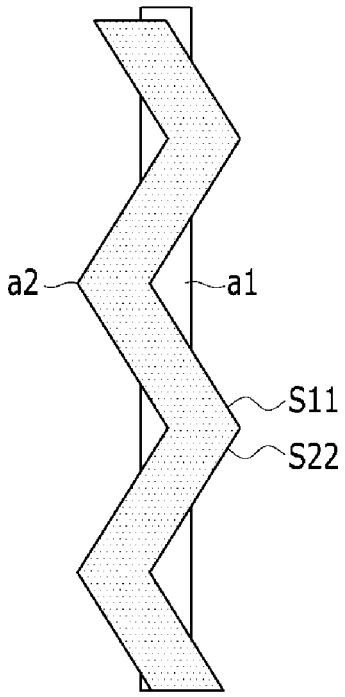
FIG. 7 illustrates a portion of a display device according to another exemplary embodiment of the present disclosure.

Next, a display device according to another exemplary embodiment of the present disclosure will be described with reference to FIG. 7 as well as FIG. 1 to FIG. 4. FIG. 7 illustrates a portion of a display device according to another exemplary embodiment of the present disclosure.

Referring to FIG. 7, a display device according to a present exemplary embodiment is similar to a display device according to an exemplary embodiment described with reference to FIG. 1 to FIG. 4, and thus a repeated detailed description of the same constituent elements is omitted.

As shown in FIG. 7, the first layer a1 of a crack sensing line of a display device according to a present exemplary embodiment has a linear shape, and the second layer a2 of a crack sensing line has a zigzag shape of alternating obliquely disposed third and fourth line segments SS1 and SS2 that are connected to each other. Accordingly, the linear shaped first layer a1 the third and fourth line segments SS1 and SS2 of the zigzag shaped second layer a2 overlap in the overlapping part O1.

However, according to the display device according to another exemplary embodiment of the present disclosure, the first layer a1 of the crack sensing line may have a square-wave shape, and the second layer a2 of the crack sensing line may have a linear shape.

In this way, a crack sensing line of a display device according to a present exemplary embodiment overlaps in the overlapping part O1, thereby forming a step in the overlapping part O1. The thickness of the insulating layer IL is less at the side of the step, so that if an external force is received, the insulating layer IL may be damaged at the step. If the insulating layer IL is damaged, the overlapping first and second layers a1 and a2 can be shorted in the overlapping part O1.

As described above, a magnitude of a voltage received by the first layer a1 of the crack sensing line may be less than the magnitude of a voltage received by the second layer a2 from the first and second data lines DD1 and DD2, and even though the first and second crack sensing lines CD1 and CD2 are not disconnected, the magnitude of the voltage received by the second layer a2 of the crack sensing line is less than that of the second voltage V2.

Accordingly, a signal transmitted to pixels connected to the first and second data lines DD1 and DD2 generates the voltage difference ΔV with the second signal V2 applied to the first and second data lines DD1 and DD2.

By causing the voltage difference ΔV, pixels connected to the first and second data lines DD1 and DD2 do not display black and are displayed brightly, and through the bright line, a crack generated in the peripheral area adjacent to the edge of the display area may be detected.

As described above, according to a display device according to an exemplary embodiment of the present disclosure, a crack sensing line includes a first layer a1 that receives a relatively low voltage and a second layer a2 that receives a relatively high voltage, and the first and second layers a1 and a2 include an overlapping part O1 where they overlap each other via the insulating layer IL. Thus, the insulating layer IL can be disconnected by the step in the overlapping part R1, so that when a crack is generated, even though the crack sensing line is not disconnected, the crack may be detected. Accordingly, failure of the display device due to the crack may be prevented.

All characteristics of a display device according to an exemplary embodiment of FIG. 1 to FIG. 4 may be applied to a display device according to a present exemplary embodiment.

Figure 8:
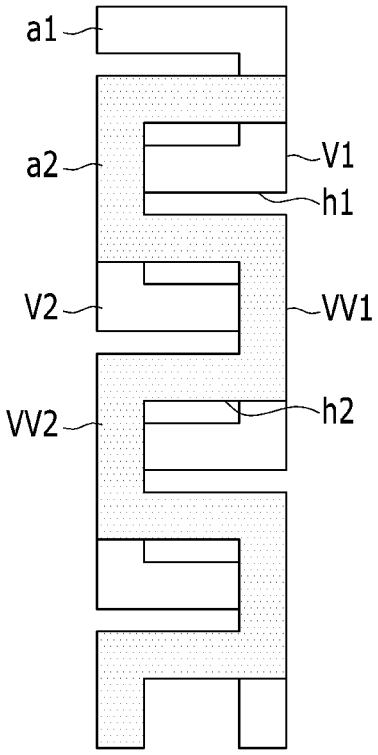
FIG. 8 illustrates a portion of a display device according to another exemplary embodiment of the present disclosure.

Next, a display device according to another exemplary embodiment of the present disclosure will be described with reference to FIG. 8 as well as FIG. 1 to FIG. 4. FIG. 8 illustrates a portion of a display device according to another exemplary embodiment of the present disclosure.

Referring to FIG. 8, a display device according to a present exemplary embodiment is similar to a display device according to a exemplary embodiment described with reference to FIG. 1 to FIG. 4, thus a repeated detailed description of the same constituent elements is omitted.

As shown in FIG. 8, the first layer a1 of a crack sensing line of a display device according to a present exemplary embodiment has a square-wave shape that includes a first longitudinal part V1 and a second longitudinal part V2 that are separated from and alternate with each other, and are connected by a first transverse part h1, and the second layer a2 of the crack sensing line has a square-wave shape that includes a third longitudinal part VV1 and a fourth longitudinal part VV2 that are separated from and alternate with each other, and are connected by a second transverse part h2.

The first transverse part h1 of the first layer a1 and the second transverse part h2 of the second layer a2 alternate with each other, and in the overlapping parts O1, the first transverse part h1 of the first layer a1 alternately overlaps the third longitudinal part VV1 and the fourth longitudinal part VV2 of the second layer a2, and the second transverse part h2 of the second layer a2 alternately overlaps the first longitudinal part V1 and the second longitudinal part V2 of the first layer a1.

In this way, a crack sensing line of a display device according to a present exemplary embodiment overlaps in the overlapping part O1, thereby forming a step in the overlapping part O1. The thickness of the insulating layer IL is less at the side of the step, so that if an external force is received, the insulating layer IL may be damaged at the step. If the insulating layer IL is damaged, the overlapping first and second layers a1 and a2 can be shorted in the overlapping part O1.

As described above, the magnitude of the voltage received by the first layer a1 of the crack sensing line may be less than the magnitude of the voltage received by the second layer a2 from the first and second data lines DD1 and DD2, and even though the first and second crack sensing lines CD1 and CD2 are not disconnected, the magnitude of the voltage received by the second layer a2 of the crack sensing line is less than that of the second voltage V2.

Accordingly, a signal transmitted to pixels connected to the first and second data lines DD1 and DD2 generates the voltage difference ΔV for the second signal V2 received by the first and second data lines DD1 and DD2.

By causing the voltage difference ΔV, pixels connected to the first and second data lines DD1 DD2 do not display black and are displayed brightly, and through the bright line, a crack generated in the peripheral area adjacent to the edge of the display area may be detected.

As described above, according to a display device according to an exemplary embodiment of the present disclosure, a crack sensing line includes a first layer a1 that received a relatively low voltage and a second layer a2 that received a relatively high voltage, and the first and second layers a1 and a2 include an overlapping part O1 where they overlap each other via the insulating layer IL. Thus, the insulating layer IL can be disconnected by the step in the overlapping part O1, and when a crack is generated, even though the crack sensing line is not disconnected, the crack may be detected. Accordingly, failure of the display device due to the crack may be prevented.

All characteristics of a display device according to an exemplary embodiment of FIG. 1 to FIG. 4 may be applied to a display device according to a present exemplary embodiment.

Figure 9:
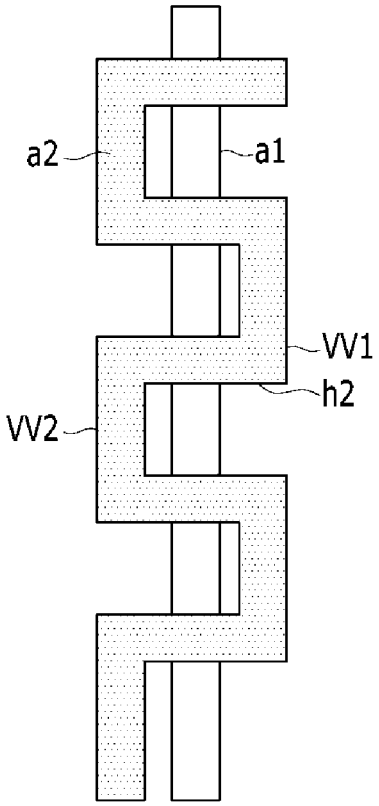
FIG. 9 illustrates a portion of a display device according to another exemplary embodiment of the present disclosure.

Next, a display device according to another exemplary embodiment of the present disclosure will be described with reference to FIG. 9 as well as FIG. 1 to FIG. 4. FIG. 9 illustrates a portion of a display device according to another exemplary embodiment of the present disclosure.

Referring to FIG. 6, a display device according to a present exemplary embodiment is similar to a display device according to an exemplary embodiment described with reference to FIG. 1 to FIG. 4, thus a repeated detailed description of the same constituent elements is omitted.

As shown in FIG. 9, the first layer a1 of a crack sensing line of a display device according to a present exemplary embodiment has a linear shape, and the second layer a2 of the crack sensing line has a square-wave shape that includes the third longitudinal part VV1 and the fourth longitudinal part VV2 that are separated and alternate with each other, and are connected to each other by the second transverse part h2.

Accordingly, the overlapping part O1 is the portion where the linear shape first layer a1 overlaps the second transverse part h2 of the second layer a2.

However, according to a display device according to another exemplary embodiment of the present disclosure, the first layer a1 of the crack sensing line may have a square-wave shape, and the second layer a2 of the crack sensing line may have a linear shape.

In this way, a crack sensing line of a display device according to a present exemplary embodiment overlaps in the overlapping part O1, thereby forming a step in the overlapping part O1. The thickness of the insulating layer IL is less the side of the step, so that if an external force is received, the insulating layer IL may be damaged at the step. If the insulating layer IL is damaged, the overlapping first and second layers a1 and a2 can be shorted in the overlapping part O1.

As described above, a magnitude of a voltage received by the first layer a1 of the crack sensing line may be less than the magnitude of a voltage received by the second layer a2 from the first and second data lines DD1 and DD2, and even though the first and second crack sensing lines CD1 and CD2 are not disconnected, the magnitude of the voltage received by the second layer a2 of the crack sensing line is less than that of the second voltage V2.

Accordingly, a signal transmitted to pixels connected to the first and second data lines DD1 and DD2 generates the voltage difference ΔV with the second signal V2 received by the first and second data lines DD1 and DD2.

By causing the voltage difference ΔV, pixels connected to the first and second data lines DD1 and DD2 do not display black and are displayed brightly, and through the bright line, a crack generated in the peripheral area adjacent to the edge of the display area may be detected.

As described above, according to an display device according to an exemplary embodiment of the present disclosure, a crack sensing line includes a first layer a1 that receives a relatively low voltage and a second layer a2 that receives a relatively high voltage and the first and second layers a1 and a2 include an overlapping part O1 where they overlap each other via the insulating layer IL. Thus, the insulating layer IL can be disconnected by the step in the overlapping part O1, so that when a crack is generated, even though the crack sensing line is not disconnected, the crack may be detected. Accordingly, failure of the display device due to the crack may be prevented.

All characteristics of a display device according to an exemplary embodiment of FIG. 1 to FIG. 4 may be applied to a display device according to a present exemplary embodiment.

While embodiments of this disclosure have been described in connection with what is presently considered to be practical exemplary embodiments, it is to be understood that embodiments of the disclosure are not limited to the disclosed exemplary embodiments, but, on the contrary, are intended to cover various modifications and equivalent arrangements included within the spirit and scope of the appended claims.

What is claimed is:

1. A display device comprising:

a substrate that includes a display area and a peripheral area around the display area;

a plurality of data lines on the substrate; and a crack sensing line disposed in the peripheral area and that is connected to a first data line of the plurality of data lines, wherein the crack sensing line includes a first layer disposed under an insulating layer and a second layer disposed on the insulating layer, the first layer include a first portion and a second portion and the second layer include a third portion and a fourth portion, the first portion of the first layer overlaps the third portion of the second layer via the insulating layer at overlapping parts, and the second portion of the first layer and the fourth portion of the second layer do not overlap each other, the first portion and the second portion of the first layer are disposed alternately and repeatedly at least three times, and the third portion and the fourth portion of the second layer are disposed alternately and repeatedly at least three times, and a voltage applied to the first layer and a voltage applied to the second layer have different magnitudes, the first layer has a square-wave shape that includes a first longitudinal part and a second longitudinal part that are separated from and alternate with each other and are connected by a first transverse part, the second layer has a square-wave shape that includes a third longitudinal part and a fourth longitudinal part that are separated from and alternate with each other, and are connected by a second transverse part, and in the overlapping parts, the first transverse part of the first layer alternately overlaps the third longitudinal part and the fourth longitudinal part of the second layer, and the second transverse part of the second layer alternately overlaps the first longitudinal part and the second longitudinal part of the first layer.

2. The display device of claim 1, wherein the second layer is connected to the first data line, and the first layer is not connected to the first data tine.

3. The display device of claim 1, further comprising a plurality of pixels formed in the display area of the substrate and that are connected to the plurality of data lines and the crack sensing line; and a first test signal line and a second test signal line formed in the peripheral area of the substrate and that are connected to the plurality of pixels, wherein the first crack sensing line is connected to the first data line through a first connection part and a second connection part the first crack sensing line extends in a hemiring shape from the first connection part to the second connection part, the plurality of data lines are connected to the first test signal line through a first switching element and are connected to the second test signal line through a second switching element.

4. A display device comprising:

a substrate that includes a display area and peripheral area around the display area;

a plurality of data lines on the substrate; and a crack sensing line disposed in the peripheral area and that is connected to a first data line of the plurality of data lines, wherein the crack sensing line includes a first layer disposed under an insulating layer and a second layer disposed on the insulating layer, the first layer include a first portion and a second portion and the second layer include a third portion and a fourth portion, the first portion of the first layer overlaps the third portion of the second layer via the insulating layer at overlapping parts, and the second portion of the first layer and the fourth portion of the second layer do not overlap each other, the first portion and the second portion of the first layer are disposed alternately and repeatedly at least three times, and the third portion and the fourth portion of the second layer are disposed alternately and repeatedly at least three times, and a voltage applied to the first layer and a voltage applied to the second layer have different magnitudes, the first layer and the second layer have planar shapes that differ from each other, the first layer has square-wave shape, and the second layer has a linear shape that extends in one direction, or the first layer has the linear shape and the second layer has the square-wave shape.

5. A display device comprising:

a substrate that includes a display area and a peripheral area around the display area;

a plurality of data lines on the substrate; and a crack sensing line disposed in the peripheral area and that is connected to a first data line of the plurality of data lines, wherein the crack sensing line includes a first layer disposed under an insulating layer and a second layer disposed on the insulating layer, the first layer include a first portion and a second portion and the second layer include a third portion and a fourth portion, the first portion of the first layer overlaps the third portion of the second layer via the insulating layer at overlapping parts, and the second portion of the first layer and the fourth portion of the second layer do not overlap each other, the first portion and the second portion of the first layer are disposed alternately and repeatedly at least three times, and the third portion and the fourth portion of the second layer are disposed alternately and repeatedly at least three times, the second layer is connected to the first data line, the first layer is not connected to the first data line, the first layer has a square-wave shape that includes a first longitudinal part and a second longitudinal part that are separated from and alternate with each other and are connected by a first transverse part, the second layer has a square-wave shape that includes a third longitudinal part and a fourth longitudinal part that are separated from and alternate with each other, and are connected by a second transverse part, and in the overlapping parts, the first transverse part of the first layer alternately overlaps the third longitudinal part and the fourth longitudinal part of the second layer, and the second transverse part of the second layer alternately overlaps the first longitudinal part and the second longitudinal part of the first layer.

6. The display device of claim 5, further comprising a plurality of pixels formed in the display area of the substrate and that are connected to the plurality of data lines and the crack sensing line; and a first test signal line and a second test signal line formed in the peripheral area of the substrate and that are connected to the plurality of pixels, wherein the first crack sensing line is connected to the first data line through a first connection part and a second connection part, the first crack sensing line extends in a hemiring shape from the first connection part to the second connection part, the plurality of data lines are connected to the first test signal line through a first switching element and are connected to the second test signal line through a second switching element.

7. A display device comprising:

a substrate that includes a display area and a peripheral are around the display area;

a plurality of data lines on the substrate; and a crack sensing line disposed in the peripheral area and that is connected to a first data line of the plurality of data lines, wherein the crack sensing line includes a first layer disposed under an insulating layer and a second layer disposed on the insulating layer, the first layer include a first portion and a second portion and the second layer include a third portion and a fourth portion, the first portion of the first layer overlaps the third portion of the second layer via the insulating layer at overlapping parts, and the second portion of the first layer and the fourth portion of the second layer do not overlap each other, the first portion and the second portion of the first layer are disposed alternately and repeatedly at least three times, and the third portion and the fourth portion of the second layer are disposed alternately and repeatedly at least three times, the second layer is connected to the first data line, the first layer is not connected to the first data line, the first layer and the second layer have planar shapes that differ from each other, the first layer has square-wave shape, and the second layer has a linear shape that extends in one direction, or the first layer has the linear shape and the second layer has the square-wave shape.

* * * * *